US010008146B2

(12) United States Patent
Guo et al.

(10) Patent No.: US 10,008,146 B2
(45) Date of Patent: Jun. 26, 2018

(54) SOURCE DRIVING CIRCUIT FOR OPTIMIZING AN ORDER OF DRIVING GRAY SCALE VOLTAGES

(71) Applicants: Shenzhen China Star Optoelectronics Technology Co., Ltd., Shenzhen (CN); Wuhan China Star Optoelectronics Technology Co., Ltd., Wuhan (CN)

(72) Inventors: Xingling Guo, Shenzhen (CN); Taisheng An, Shenzhen (CN); Man Li, Shenzhen (CN)

(73) Assignees: Shenzhen China Star Optoelectronics Technology Co., Ltd., Shenzhen (CN); Wuhan China Star Optoelectronics Technology Co., Ltd., Wuhan (CN)

( * ) Notice: Subject to any disclaimer, the term of this patent is extended or adjusted under 35 U.S.C. 154(b) by 192 days.

(21) Appl. No.: 14/893,095

(22) PCT Filed: Sep. 6, 2015

(86) PCT No.: PCT/CN2015/088963

§ 371 (c)(1),
(2) Date: Nov. 23, 2015

(87) PCT Pub. No.: WO2017/028343

PCT Pub. Date: Feb. 23, 2017

(65) Prior Publication Data

US 2017/0140695 A1 May 18, 2017

(30) Foreign Application Priority Data

Aug. 19, 2015 (CN) ..... 2015 1 0510802

(51) Int. Cl.
*G09G 3/20* (2006.01)

(52) U.S. Cl.
CPC ... *G09G 3/2092* (2013.01); *G09G 2300/0452* (2013.01); *G09G 2310/027* (2013.01);
(Continued)

(58) Field of Classification Search
CPC ..... G09G 3/3688; G09G 2310/0213; G09G 2310/027; G09G 2310/061; G09G 2310/0235
See application file for complete search history.

(56) References Cited

U.S. PATENT DOCUMENTS 6,636,187 B2 10/2003 Tajima et al.
2008/0042689 A1 * 2/2008 Yen ..... G09G 3/3688 326/82

(Continued)

FOREIGN PATENT DOCUMENTS

CN 1917003 2/2007
CN 102693701 9/2012

(Continued)

*Primary Examiner* — Sepehr Azari

(57) ABSTRACT

A source driving circuit is provided. The source driving circuit includes a digital-to-analog conversion module configured for converting raw image data into gray-scale image data; an optimization module configured for obtaining an optimal output sequence of the gray-scale values in pixel units for each row in a display panel and outputting the gray-scale values of each pixel in pixel units corresponding to data lines by following the order of the optimal output sequence to form a first image data; and a buffer module configured for enhancing a load driving capability of the first image data outputted by the optimization module.

13 Claims, 5 Drawing Sheets

(52) U.S. Cl.
CPC ..... *G09G 2310/0286* (2013.01); *G09G 2310/0291* (2013.01)

(56) References Cited

U.S. PATENT DOCUMENTS

| | | | | |
|---|---|---|---|---|
| 2009/0027100 | A1* | 1/2009 | Choi | G09G 3/3266 327/333 |
| 2012/0086677 | A1* | 4/2012 | Lin | G09G 3/20 345/204 |
| 2012/0162171 | A1* | 6/2012 | Chaing | G09G 3/3648 345/209 |
| 2012/0280959 | A1 | 11/2012 | Shiu et al. | |
| 2015/0117774 | A1* | 4/2015 | Yang | G06T 9/00 382/166 |

FOREIGN PATENT DOCUMENTS

| | | |
|---|---|---|
| CN | 102768818 | 11/2012 |
| CN | 104577440 | 4/2015 |
| CN | 104715729 | 6/2015 |

* cited by examiner

SOURCE DRIVING CIRCUIT FOR OPTIMIZING AN ORDER OF DRIVING GRAY SCALE VOLTAGES

RELATED APPLICATIONS

This application is a National Phase of PCT Patent Application No. PCT/CN2015/088963 having International filing date of Sep. 6, 2015, which claims the benefit of priority of Chinese Patent Application No. 201510510802.1 filed on Aug. 19, 2015. The contents of the above applications are all incorporated by reference as if fully set forth herein in their entirety.

BACKGROUND OF THE INVENTION

Field of the Invention

The present invention relates to display device technology, and more particularly to a source driving circuit.

Description of Prior Art

FIG. 1 shows a schematic diagram of a source driving circuit of a liquid crystal display panel in the prior art, and merely the source driving circuit having a plurality of data channels D1-DN is shown. As shown in FIG. 1, the source driving circuit 10 includes a shift register 11, and further includes a first latch 12, a second latch 13, a level converter 14, a digital to analog converter (DAC) 15, and an output buffer 16 corresponding to each data channel. Specifically, the shift register 11 is electrically connected to the respective first latches 12 on the plurality of data channels. Furthermore, the shift register 11 sequentially selects the first latch 12 of one of the data channels, and then the data signal is transmitted to the corresponding data line. Taking the first and the second data channels as an example, the first latch 12 of the first data channel D1 is, respectively, connected to the second latch 13 of the first data channel D1 and the second latch 13 of the second data channel D2, and the first latch 12 of the second data channel D2 is, respectively, connected to the second latch 13 of the first data channel D1 and the second latch 13 of the second data channel D2.

The first latch 13 of each data channel sequentially is electrically connected to the output buffer 16 through the level converter 14 and the DAC 15. The output buffer 16 of the first data channel D1 is, respectively, electrically connected to an output terminal of the second data channel D2 and an output terminal of the first data channel D1. The output buffer 16 of the second data channel D2 is, respectively, electrically connected to the output terminal of the second data channel D2 and the output terminal of the first data channel D1.

With the development of technology, three or four data are orderly outputted by an identical data channel in order to raise the data transfer rate. As shown in FIG. 2, a white gray-scale data 21, a red gray-scale data 22, a blue gray-scale data 23, and a green gray-scale data 24 (i.e. a structure with channel to gray-scale data ratio 1:4) are outputted on the data channel on the left side of FIG. 2; while a white gray-scale data 26, a red gray-scale data 27, a blue gray-scale data 28, and a green gray-scale data 29 are outputted on the data channel of the right side of FIG. 2. Along with a turning on and a turning off of switches sequentially of channels 41, 42, 43, and 44 in a display panel 30, four data RGBW are outputted with the operations of the switches are sequentially outputted. In this manner, a corresponding data, i.e. a green data, a blue data, a red data and a white data (G, B, R, W), can be sent to a corresponding pixel. That is, the green gray-scale data 24, the blue gray-scale data 23, the red gray-scale data 22, and the white gray-scale data 21 are respectively inputted to a corresponding green pixel 31, a corresponding blue pixel 32, a corresponding red pixel 33, and a corresponding white pixel 34, which are located on the data lines of the display panel 30 on the left side while the green gray-scale data 29, the blue gray-scale data 28, the red gray-scale data 27, and the white gray-scale data 26 are inputted to a corresponding green pixel 35, a corresponding blue pixel 36, a corresponding red pixel 37, and a corresponding white pixel 38, which are located on the data lines of the display panel 30 on the right side. Although the number of data channels of this kind of circuit can be reduced, larger power consumption will be caused when there is a larger difference existing between the gray-scale values of two adjacent pixels, since a plurality of gray-scale data are inputted through an identical data line.

Therefore, it is necessary to provide a source driving circuit to solve the existing problems in the prior art.

SUMMARY OF THE INVENTION

An object of the present invention is to provide a source driving circuit to solve a technical problem of the conventional source driving circuit in which its power consumption is larger when multiple gray-scale data are outputted by an identical data channel.

To solve the foregoing problems, a source driving circuit is provided according to an embodiment of the present invention, the source driving circuit comprises:

- a digital-to-analog conversion module configured for converting raw image data into gray-scale image data, which includes all inputted gray-scale values of pixels, wherein the source driving circuit is inputted with the raw image data;
- an optimization module configured for obtaining an optimal output sequence of the gray-scale values of the pixels in pixel units for each row in a display panel and outputting the gray-scale values of the respective pixels in the pixel units corresponding to data lines by following the order of the optimal output sequence to form a first image data, the optimization module comprising:
  - a gray-scale acquisition unit configured for acquiring the gray-scale values of each pixel in the pixel units for each row corresponding to the data lines;
  - a display sequence arrangement unit configured for arranging display sequences of the pixel units corresponding to each data line by following a descending or ascending order of the grayscale values acquired by the gray-scale acquisition unit to obtain a plurality of display sequences;
  - an energy-consumption value acquisition unit configured for sequentially using each display sequence obtained from the display sequence arrangement unit to calculate an energy-consumption value of the whole display panel to acquire a plurality of energy-consumption values and setting the display sequence having a minimum energy-consumption value as the optimal output sequence; wherein the display panel comprises a plurality of data lines and a plurality of pixel units, the pixel unit comprises at least three color pixels; and
- a buffer module configured for enhancing a load driving capability of the first image data outputted by the optimization module and inputting the first image data into the pixels, the buffer module including a plurality of output buffers corresponding to the data lines, and an output terminal of the output buffer on one of per pair of the data lines being connected to an output terminal of an output buffer on a remaining one of the pair of the data lines.

In the above source driving circuit, the energy-consumption value is an overall average value of differences between gray-scale values of two adjacent pixels in pixel units for all rows in the display panel.

In the above source driving circuit, the energy-consumption value acquisition unit is specifically configured for calculating the average value of the differences between the gray-scale values of two adjacent pixels in the pixel units for each row by sequentially using display sequences to obtain the average value of the differences between the gray-scale values of two adjacent pixels for the whole display panel.

In the above source driving circuit, the source driving circuit further comprises a latch module which includes a plurality of latches corresponding to the data lines, and the latches are configured for storing the raw image data; an output terminal of the latch on one data line of per pair of the data lines is connected to an output terminal of a latch on a remaining data line of the pair of the data lines.

In the above source driving circuit, the source driving circuit further comprises a level conversion module which includes a plurality of level converters corresponding to the data lines, and the level converters are configured to raise a voltage of the stored raw image data.

In the above source driving circuit, the digital-to-analog conversion module is further configured for converting the raw image data, of which the voltage has been raised by the level conversion module, into a gray-scale image data.

In the above source driving circuit, pixels with the same color in the pixel units for each row simultaneously receive their corresponding gray-scale values.

In the above source driving circuit, the pixel unit comprises a red pixel, a green pixel, a blue pixel, and a white pixel.

According to another embodiment of the present invention, a source driving circuit comprises:

a digital-to-analog conversion module configured for converting raw image data into gray-scale image data, which includes all inputted gray-scale values of pixels, wherein the source driving circuit is inputted with the raw image data;

an optimization module configured for obtaining an optimal output sequence of the gray-scale values of the pixels in pixel units for each row in a display panel and outputting the gray-scale values of each pixel in pixel units corresponding to data lines by following the order of the optimal output sequence to form a first image data, wherein the display panel comprises a plurality of data lines and a plurality of pixel units, the pixel unit comprises at least three color pixels; and a buffer module configured for enhancing a load driving capability of the first image data outputted by the optimization module and inputting the first image data into the pixels.

In the above source driving circuit, the optimization module comprises:

a gray-scale acquisition unit configured for acquiring the gray-scale values of each pixel in the pixel unit for each row corresponding to the data lines;

a display sequence arrangement unit configured for arranging display sequences of the pixel units corresponding to each data line by following a descending or ascending order of the grayscale values acquired by the gray-scale acquisition unit to obtain a plurality of display sequences; and an energy-consumption value acquisition unit configured for sequentially using each display sequence obtained from the display sequence arrangement unit to calculate an energy-consumption values of the whole display panel to acquire a plurality of energy-consumption values and setting the display sequence having a minimum energy-consumption value as the optimal output sequence.

In the above source driving circuit, the energy-consumption value is an overall average value of differences between gray-scale values of two adjacent pixels in pixel units for all rows in the display panel.

In the above source driving circuit, the energy-consumption value acquisition unit is specifically configured for calculating the average value of the differences between the gray-scale values of two adjacent pixels in the pixel units for each row by sequentially using display sequences to obtain the average value of the differences between the gray-scale values of two adjacent pixels for the whole display panel.

In the above source driving circuit, the buffer module comprises a plurality of output buffers corresponding to the data lines, and an output terminal of an output buffer on one of per pair of the data lines is connected to an output terminal of an output buffer on a remaining one of the pair of the data lines.

In the above source driving circuit, the source driving circuit further comprises a latch module which includes a plurality of latches corresponding to the data lines, and the latches are configured for storing the raw image data; an output terminal of the latch on one data line of per pair of the data lines is connected to an output terminal of a latch on the remaining data line of the pair of the data lines.

In the above source driving circuit, the source driving circuit further comprises a level conversion module which includes a plurality of level converters corresponding to the data lines, and the level converters are configured to raise a voltage of the stored raw image data.

In the above source driving circuit, the digital-to-analog conversion module is further configured for converting the raw image data, of which the voltage has been raised by the level conversion module, into a gray-scale image data.

In the above source driving circuit, pixels with the same color in the pixel units for each row simultaneously receive their corresponding gray-scale values.

In the above source driving circuit, the pixel unit comprises a red pixel, a green pixel, a blue pixel, and a white pixel.

The source driving circuit of the present invention can reduce power consumption of the display panel and thereby lower production costs by means of optimizing the output sequence of the gray-scale values of the conventional driving circuit.

DETAILED DESCRIPTION OF THE INVENTION

The preferred embodiments of the present invention will be detailed in the following in combination with the accompanying drawings. The drawings are drawn schematically, and do not limit the protection scope thereof, and the same reference numbers are used to indicate the same or similar components throughout the drawings. Spatially relative terms, such as "above", "beneath", "front", "behind", "left", "right", "inner", "outer", and the like may be used herein for reference to describe one element's relationship to another element(s) as illustrated in the figures, rather than its restrictions.

Figure 1:
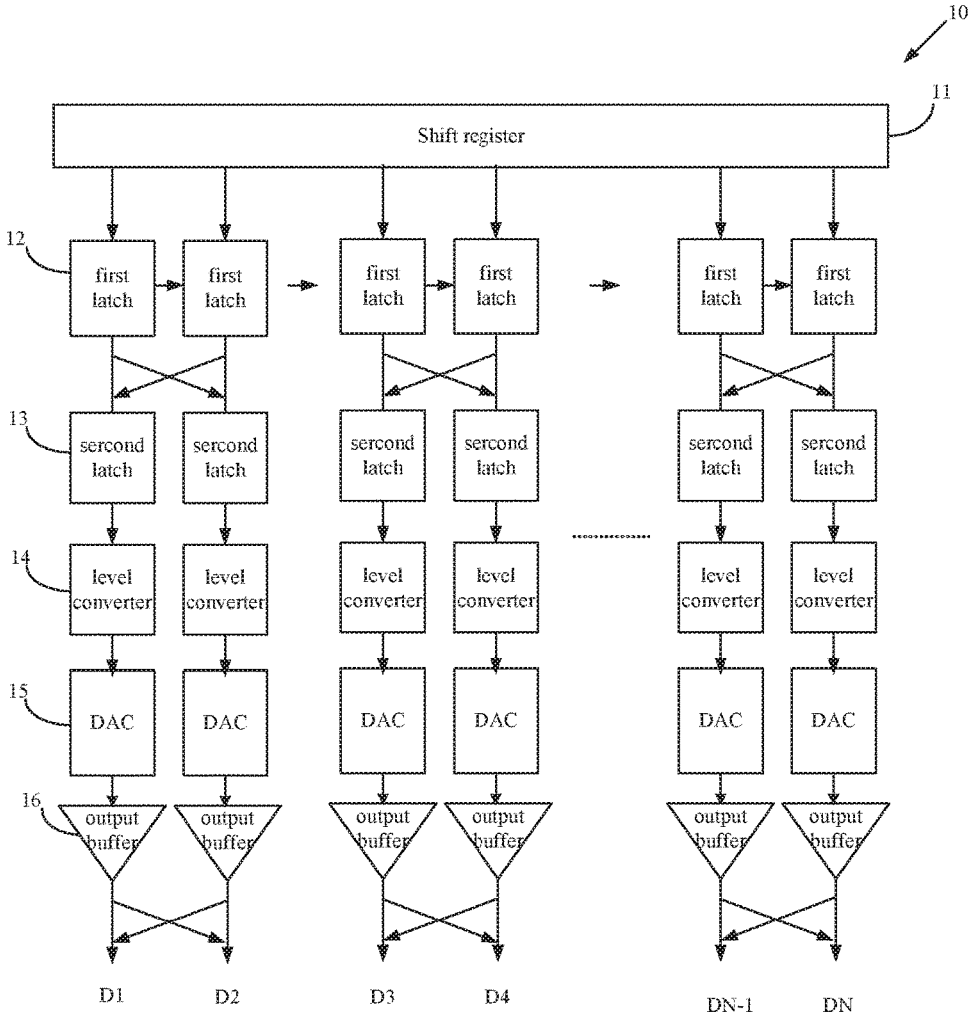
FIG. 1 PRIOR ART
FIG. 1 is a structural schematic diagram of a source driving circuit in the prior art.
Figure 2:
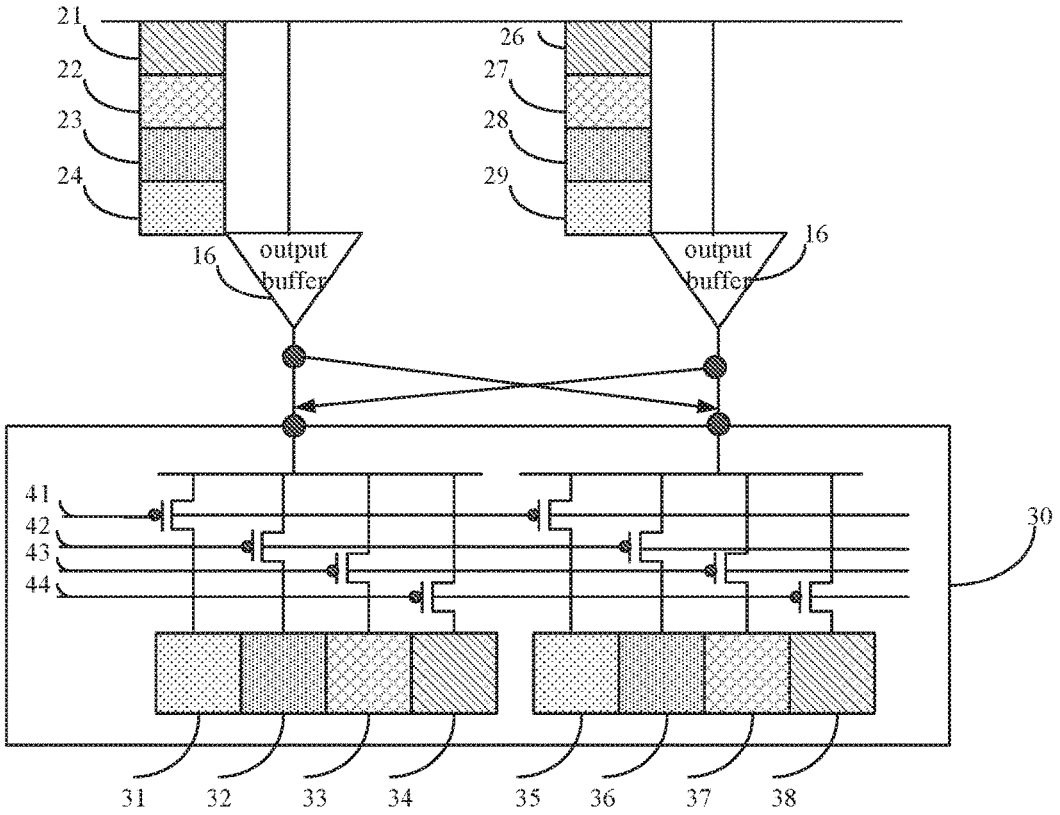
FIG. 2 PRIOR ART
FIG. 2 is a driving schematic diagram of a source driving circuit in the prior art.
Figure 3:
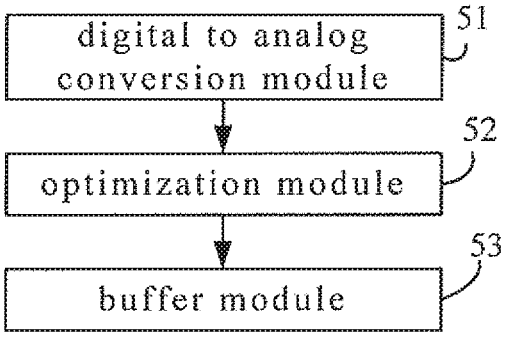
FIG. 3 is a structural schematic diagram of a source driving circuit in accordance with a first embodiment of the present invention.

Refer to FIG. 3, which is a structural schematic diagram of a source driving circuit in accordance with a first embodiment of the present invention.

In a display panel which the source driving circuit of the present invention is applied to, the display panel comprises a plurality of data lines for inputting data signals; a plurality of scan lines for inputting scan signals; and a plurality of pixel units formed by defining the data lines and the scanning lines. The pixel unit comprises pixels that have three colors. For example, the pixel unit may include a red pixel, a green pixel, a blue pixel, and it may also include a white pixel.

The source driving circuit, shown in FIG. 3, comprises a digital-to-analog conversion module 51, an optimization module 52, and a buffer module 53.

The source driving circuit is inputted with raw image data. The digital-to-analog conversion module 51 is configured for converting the raw image data into gray-scale image data, which includes inputted gray-scale values (gray-scale voltages) of all pixels. That is, the digital raw image data is converted into an analog gray-scale voltage.

The optimization module 52 is configured for obtaining an optimal output sequence of the gray-scale values in pixel units for each row in the display panel and outputting the gray-scale values of each pixel in pixel units corresponding to data lines by following the order of the optimal output sequence to form a first image data.

The buffer module 53 is configured for enhancing a load driving capability of the first image data outputted by the optimization module 52, and then the first image data is inputted into the pixels.

This embodiment can obtain an optimal output sequence of three or four gray-scale values for each output of the source driving circuit, e.g. getting a best ascending or descending order, by adding the optimization module, so that differences of voltages outputted by the source driving chip can be minimized and thereby reducing the power consumption of the display panel.

Figure 4:
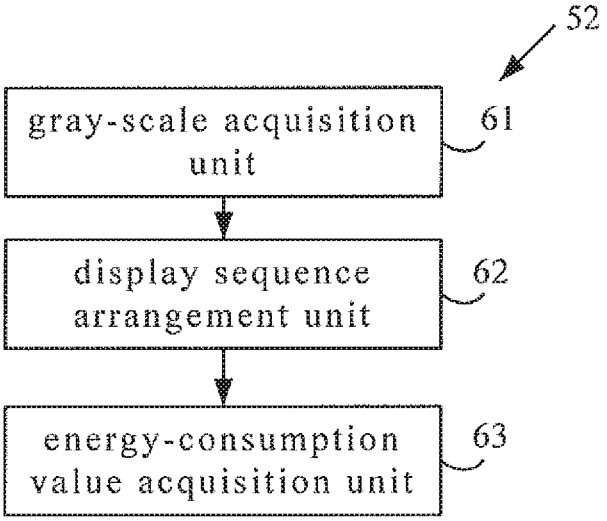
FIG. 4 is a structural schematic diagram of an optimization module of the source driving circuit in accordance with the first embodiment of the present invention.

Preferably, as shown in FIG. 4, the optimization module 52 includes a gray-scale acquisition unit 61, a display sequence arrangement unit 62, and an energy-consumption value acquisition unit 63.

The gray-scale acquisition unit 61 is configured for acquiring the gray-scale values of each pixel in the pixel units for each row corresponding to the data lines.

The display sequence arrangement unit 62 is configured for arranging display sequences of the pixel units corresponding to each data line by following a descending or ascending order of the grayscale values acquired by the gray-scale acquisition unit to obtain a plurality of display sequences.

The energy-consumption value acquisition unit 63 is configured for sequentially using each display sequence from the display sequence arrangement unit to calculate a value of the whole energy consumption of the display panel, so as to obtain a plurality of energy-consumption values. Accordingly, the display sequence which has a minimum energy-consumption value is set as the optimal output sequence.

Preferably, the energy-consumption value is an overall average value of differences between gray-scale values of two adjacent pixels on the whole display panel.

Preferably, the energy-consumption value acquisition unit 63 is specifically configured for calculating an average value of differences between gray-scale values of two adjacent pixels in pixel units for each row by sequentially using display sequences to obtain the average value of the differences between the gray-scale values of the two adjacent pixels for the whole display panel.

Figure 5:
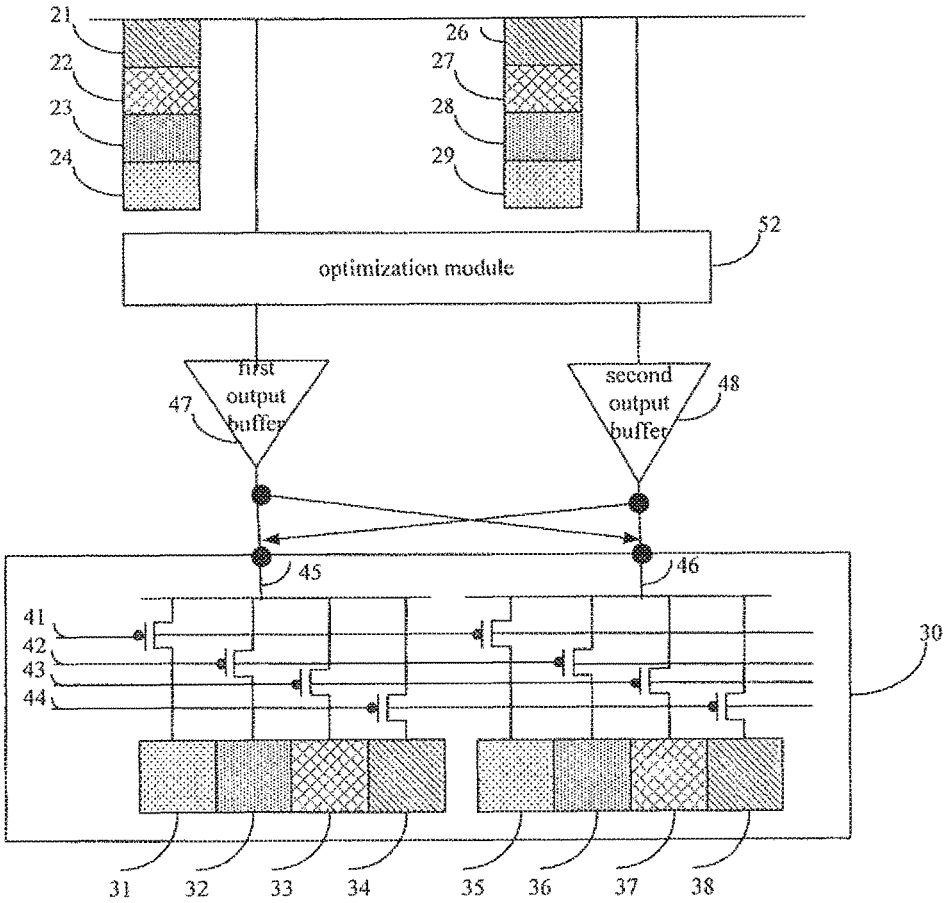
FIG. 5 is a driving schematic diagram of a source driving circuit in accordance with an embodiment of the present invention.

In conjunction with FIG. 5, the pixels with the same color in pixel units of an identical row in the display panel 30 are controlled by an identical signal seen from the FIG. 5, so that the pixels with the same color in the pixel units for each row simultaneously receive their corresponding gray-scale values. For example, when the green gray-scale data arrives, the switch of the first row 41 is turned on and the green pixel 31 or 35 in the pixel unit of the first row receives the green gray-scale data on the data line 45 or the data line 46; when the red gray-scale data arrives, the switch of the second row 42 is turned on and the red pixel 32 or 36 in the pixel unit of the first row receives the red gray-scale data on the data line 45 or the data line 46, a similar controlling operation can be applied to the remaining switches of the rest of rows.

Following the turning on and the turning off of the switches sequentially of the channels 41, 42, 43, and 44 in the display panel 30, the four data RGBW are sequentially outputted along with the switches, namely, a green gray-scale data, a blue gray-scale data, a red gray-scale data, and a white gray-scale data are sequentially outputted.

For an example of two data lines, the gray-scale data acquisition unit 61 obtains respectively the corresponding gray-scale values of the pixels 31-34 on the data line 45 and the corresponding gray-scale values of the pixels 35-38 on the data line; for instance, a red gray-scale value of 255, a green gray-scale value of 0, and a blue gray-scale value of 255 are outputted on the data line 45 while a red gray-scale value of 125, a green gray-scale value of 75, and a blue gray-scale value of 200 are outputted on the data line 46. Next, the display sequence arrangement unit 62 sorts out a display sequence according to the grayscale values in descending or ascending order, and the display sequence for an output on the data line 45 is the green gray-scale value of 0 first, subsequently the blue gray-scale value of 255, and finally the red gray-scale value of 255; and the corresponding pixel unit on the data line 45 follows the GBR display sequence to perform the output operation; the display sequence for an output on the data line 46 is the green gray-scale value of 75 first, subsequently the red gray-scale value of 125, and finally the blue gray-scale value of 200; and the corresponding pixel unit on the data line 46 follows the GRB display sequence to perform the output operation, and thereby two display sequences of GBR and GRB are obtained.

The energy-consumption value acquisition unit 63 calculates respectively an energy-consumption value for the display sequence of GBR and GRB, specific details are as follows.

First, according to the display sequence of GBR, differences between gray-scale values of two adjacent pixels in pixel units for each row are calculated, and then an average value of the differences between the gray-scale values of two adjacent pixels in the pixel units for all rows is calculated. The average value is referred to as an energy-consumption value.

Next, according to the display sequence of GRB, differences between gray-scale values of two adjacent pixels in pixel units for each row are calculated, and then an average value of the differences between the gray-scale values of two adjacent pixels in the pixel units for all rows is calculated. The average value is referred to as an energy-consumption value.

These two energy-consumption values described above are compared, and the display sequence corresponding to a minimum energy-consumption value is set as an output sequence for all the data lines.

For example, after the energy-consumption values have been calculated, the display sequence of GRB has a minimum energy-consumption value. Therefore, the gray-scale values on all the data lines are outputted by following the order of the display sequence of GRB.

Preferably, the buffer module 53 includes a plurality of output buffers corresponding to the data lines. For example, in FIG. 5, the data line 45 is connected to a first output buffer 47, and the data line 46 is connected to a second output buffer 48; the first output buffer 47 is, e.g., a positive polarity buffer, and the second output buffer 48 is, e.g. a negative polarity buffer, and an output terminal of an output buffer on one data line is connected to an output terminal of an output buffer on a remaining data line of the pair of data lines. The first output buffer 47 is connected to the output terminals on the data line 45 and the data line 46; and the second output buffer 48 is connected to the output terminals on the data line 46 and the data line 45, such that it is possible to reduce driving lines of the source driving circuit.

By adding the optimization module, an optimal ascending or descending sequence is obtained after the three or four gray-scale values of each output of the source driving circuit have been compared, so that differences of voltages of the source driving chip can be minimized and thereby reducing the power consumption of the display panel.

Figure 6:
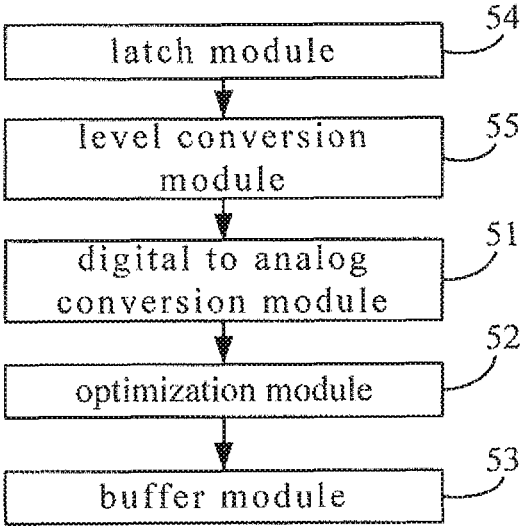
FIG. 6 is a structural schematic diagram of a source driving circuit in accordance with a second embodiment of the present invention.

Refer to FIG. 6, which is a structural schematic diagram of a source driving circuit in accordance with a second embodiment of the present invention.

The difference between the second embodiment and the previous embodiment is that the source driving circuit further comprises a latch module 54 and a level conversion module 55.

The latch module 54 includes a plurality of latches corresponding to the data lines, and the latches are configured for storing the raw image data. An output terminal of a latch on one data line of per pair of the data lines is connected to an output terminal of a latch on a remaining data line of the pair of the data lines.

The level conversion module 55 includes a plurality of level converters corresponding to the data lines, and the level converters are configured to raise a voltage of the stored raw image data.

Furthermore, the digital-to-analog conversion module 51 is further configured to convert the raw image data, of which the voltage has been raised by the level conversion module, into a gray-scale image data.

The source driving circuit of the present invention can reduce power consumption of a display panel and thereby lower production costs by means of optimizing an output sequence of gray-scale values of a conventional driving circuit.

In summary, while the present invention has been described with the aforementioned preferred embodiments, it is preferable that the descriptions relating to the above embodiments should be construed as exemplary rather than as limiting of the present invention. One of ordinary skill in the art can make a variety of modifications and variations without departing from the spirit and scope of the present invention as defined by the following claims.

What is claimed is:

1. A source driving circuit comprising:

a plurality of data lines and a plurality of pixel units included in a display panel;

a digital-to-analog conversion module configured for converting raw image data into gray-scale image data, which includes all inputted gray-scale values of pixels, wherein the source driving circuit is inputted with the raw image data;

an optimization module configured for obtaining an optimal output sequence of the gray-scale values of the pixels in the pixel units for each row in the display panel and outputting the gray-scale values of the respective pixels in the pixel units corresponding to the data lines by following an order of the optimal output sequence to form a first image data, the optimization module comprising:

a gray-scale acquisition unit configured for acquiring the gray-scale values of each pixel in the pixel units for each row corresponding to the data lines;

a display sequence arrangement unit configured for arranging display sequences of the pixel units corresponding to each data line by following a descending or ascending order of the grayscale values acquired by the gray-scale acquisition unit to obtain a plurality of display sequences;

an energy-consumption value acquisition unit configured for sequentially using each display sequence obtained from the display sequence arrangement unit to calculate an energy-consumption value of the whole display panel to acquire a plurality of energy-consumption values and setting the display sequence having a minimum energy-consumption value as the optimal output sequence; wherein the pixel unit comprises at least three color pixels; and a buffer module configured for enhancing a load driving capability of the first image data outputted by the optimization module and inputting the first image data into the pixels, the buffer module including a plurality of output buffers corresponding to the data lines, and an output terminal of the output buffer on one data line of per pair of the data lines being connected to an output terminal of an output buffer on a remaining one data line of the pair of the data lines;

wherein the energy-consumption value is an average value of differences between gray-scale values of two adjacent pixels in the pixel units for all rows in the display panel, wherein no pixel is located between the two adjacent pixels, and the two adjacent pixels are in different colors; and wherein the energy-consumption value acquisition unit is further configured for calculating the average value of the differences between the gray-scale values of two adjacent pixels in the pixel units for each row by sequentially using display sequences to obtain the average value of the differences between the gray-scale values of two adjacent pixels for the whole display panel, wherein no pixel is located between the two adjacent pixels, and the two adjacent pixels are in different colors.

2. The source driving circuit according to claim 1, wherein the source driving circuit further comprises a latch module which includes a plurality of latches corresponding to the data lines, and the latches are configured for storing the raw image data; an output terminal of the latch on one of per pair of the data lines is connected to an output terminal of a latch on a remaining data line of the pair of the data lines.

3. The source driving circuit according to claim 2, wherein the source driving circuit further comprises a level conversion module which includes a plurality of level converters corresponding to the data lines, and the level converters are configured to raise a voltage of the stored raw image data.

4. The source driving circuit according to claim 3, wherein the digital-to-analog conversion module is further configured for converting the raw image data, of which the voltage has been raised by the level conversion module, into a gray-scale image data.

5. The source driving circuit according to claim 1, wherein pixels with the same color in the pixel units for each row simultaneously receive their corresponding gray-scale values.

6. The source driving circuit according to claim 1, wherein the pixel unit comprises a red pixel, a green pixel, a blue pixel, and a white pixel.

7. A source driving circuit comprising:

a plurality of data lines and a plurality of pixel units included in a display panel;

a digital-to-analog conversion module configured for converting raw image data into gray-scale image data, which includes all inputted gray-scale values of pixels, wherein the source driving circuit is inputted with the raw image data;

an optimization module configured for obtaining an optimal output sequence of the gray-scale values of the pixels in the pixel units for each row in the display panel and outputting the gray-scale values of the respective pixels in the pixel units corresponding to the data lines by following an order of the optimal output sequence to form a first image data, wherein the pixel unit comprises at least three color pixels; and a buffer module configured for enhancing a load driving capability of the first image data outputted by the optimization module and inputting the first image data into the pixels;

wherein the optimization module comprises:

a gray-scale acquisition unit configured for acquiring the gray-scale values of each pixel in the pixel unit for each row corresponding to the data lines;

a display sequence arrangement unit configured for arranging display sequences of the pixel units corresponding to each data line by following a descending or ascending order of the grayscale values acquired by the gray-scale acquisition unit to obtain a plurality of display sequences; and an energy-consumption value acquisition unit configured for sequentially using each display sequence obtained from the display sequence arrangement unit to calculate an energy-consumption values of the whole display panel to acquire a plurality of energy-consumption values and setting the display sequence having a minimum energy-consumption value as the optimal output sequence;

wherein the energy-consumption value is an average value of differences between gray-scale values of two adjacent pixels in pixel units for all rows in the display panel, wherein no pixel is located between the two adjacent pixels, and the two adjacent pixels are in different colors; and wherein the energy-consumption value acquisition unit is specifically configured for calculating the average value of the differences between the gray-scale values of two adjacent pixels in the pixel units for each row by sequentially using display sequences to obtain the average value of the differences between the gray-scale values of two adjacent pixels for the whole display panel, wherein no pixel is located between the two adjacent pixels, and the two adjacent pixels are in different colors.

8. The source driving circuit according to claim 7, wherein the buffer module comprises a plurality of output buffers corresponding to the data lines, and an output terminal of the output buffer on one of per pair of the data lines is connected to an output terminal of an output buffer on a remaining one of the pair of the data lines.

9. The source driving circuit according to claim 7, wherein the source driving circuit further comprises a latch module which includes a plurality of latches corresponding to the data lines, and the latches are configured for storing the raw image data; an output terminal of the latch on one of per pair of the data lines is connected to an output terminal of a latch on a remaining data line of the pair of the data lines.

10. The source driving circuit according to claim 9, wherein the source driving circuit further comprises a level conversion module which includes a plurality of level converters corresponding to the data lines, and the level converters are configured to raise a voltage of the stored raw image data.

11. The source driving circuit according to claim 10, wherein the digital-to-analog conversion module is further configured for converting the raw image data, of which the voltage has been raised by the level conversion module, into a gray-scale image data.

12. The source driving circuit according to claim 7, wherein pixels with the same color in the pixel units for each row simultaneously receive their corresponding gray-scale values.

13. The source driving circuit according to claim 7, wherein the pixel unit comprises a red pixel, a green pixel, a blue pixel, and a white pixel.

* * * * *